US005713101A

United States Patent [19]

Jackson

[11] Patent Number: 5,713,101

[45] Date of Patent: Feb. 3, 1998

[54] NOZZLES AND CONTAINER CLEANING SYSTEM

[76] Inventor: Robert L. Jackson, 856 Kirkland Rd., Batesburg, S.C. 29006

[21] Appl. No.: 571,354

[22] Filed: Dec. 13, 1995

[51] Int. Cl.[6] ..... B08B 3/02; B08B 5/02

[52] U.S. Cl. ..... 15/302; 15/304; 15/316.1; 134/62; 134/95.2; 134/95.3; 134/167 R

[58] Field of Search ..... 15/302, 304, 316.1; 134/95.2, 95.3, 167 R, 168 R, 62

[56] References Cited

U.S. PATENT DOCUMENTS

| | | | |
|---|---|---|---|
| 1,647,582 | 11/1927 | Roberts | 239/204 |
| 1,751,723 | 3/1930 | Borgeson | 239/205 |
| 1,954,863 | 4/1934 | Coles et al. | 239/204 |
| 2,091,790 | 8/1937 | Mueller et al. | 239/204 |
| 2,260,449 | 10/1941 | Goldwyn | 15/304 |
| 2,298,475 | 10/1942 | Fechheimer | 15/304 X |
| 2,309,325 | 1/1943 | Merrill | 15/304 X |
| 2,398,356 | 4/1946 | Burwick et al. | 15/304 X |
| 2,399,112 | 4/1946 | Glover | 239/205 |
| 2,404,286 | 7/1946 | Graham | 134/167 R |
| 2,814,575 | 11/1957 | Lange | 15/302 X |
| 2,909,325 | 10/1959 | Hunter | 239/205 |
| 3,000,575 | 9/1961 | Hruby, Jr. | 239/204 |
| 3,033,467 | 5/1962 | Hofer | 239/204 |
| 3,063,645 | 11/1962 | Tropeano et al. | 239/206 |
| 3,104,407 | 9/1963 | Volk | 134/168 |
| 3,118,609 | 1/1964 | Glover | 239/205 |
| 3,246,847 | 4/1966 | Hammelmann | 239/752 |
| 3,444,869 | 5/1969 | Guignon et al. | 134/167 |
| 3,503,555 | 3/1970 | Lockwood et al. | 239/204 |
| 3,529,773 | 9/1970 | Barnum | 239/204 |
| 3,567,125 | 3/1971 | Houghton | 239/204 |
| 3,645,452 | 2/1972 | Stoeckel et al. | 134/168 |
| 3,696,825 | 10/1972 | Guignon et al. | 134/167 |
| 3,791,583 | 2/1974 | Nunlist et al. | 134/167 |
| 4,058,412 | 11/1977 | Knapp et al. | 134/24 |
| 4,082,057 | 4/1978 | Hayes | 118/9 |
| 4,166,754 | 9/1979 | Scheel et al. | 134/24 |
| 4,628,972 | 12/1986 | LaRochelle | 141/91 |
| 4,646,768 | 3/1987 | Tanaka et al. | 134/167 |
| 4,781,327 | 11/1988 | Lawson et al. | 239/203 |
| 4,945,862 | 8/1990 | Vadakin | 122/392 |
| 4,961,440 | 10/1990 | Wright | 134/167 |
| 5,107,873 | 4/1992 | Clinger | 134/56 |
| 5,135,170 | 8/1992 | Takeda et al. | 239/205 |
| 5,163,618 | 11/1992 | Cordua | 239/205 |
| 5,478,406 | 12/1995 | Derby et al. | 15/304 X |

*Primary Examiner*—Chris K. Moore
*Attorney, Agent, or Firm*—Michael A. Mann

[57] ABSTRACT

A nozzle and container cleaning system for rinsing and washing the interior of a flexible container. The system comprises a bulk bag dispenser having a concentric reducer and a pair of nozzles. The nozzles comprise an inner and outer cylinder, where the outer cylinder penetrates through the wall of the reducer, so that it communicates with the interior of the bag. The inner cylinder has a conduit and is slidably mounted within the outer cylinder and has an extended and retracted position. The conduit is connected to a fluid source which provides a pressurized fluid, either liquid or gas. The fluid is forced through a set of orifices in the inner cylinder and into the interior of the bag when the inner cylinder is between its two positions, thus expanding and rinsing the interior of the bag. The orifices have a notch positioned proximate to where the orifices exit the inner cylinder to better adjust the spray pattern of the fluid. As the inner cylinder moves between its two positions, a cap affixed to its top end lifts the bag so that more of the bag is exposed to the fluid. Furthermore, when the inner cylinder is in its retracted position, the combination of the cap and a plurality of seals prevents fluid from flowing into the reducer or into the interior of the bag.

10 Claims, 2 Drawing Sheets

70
60
64
65
110
140
132

80
150
152
66
78
76
50
154
156
82
98
62
78
76
72
98
94
22
24
92
70
60

80
82
150
62
66
76
78
100
76
76
72
98
96
152
94
154
156
98
22
24
100
92
50
90
70
60

NOZZLES AND CONTAINER CLEANING SYSTEM

BACKGROUND OF THE INVENTION

1. Field of the Invention

The present invention relates to a device for cleaning the interior of a container. In particular, the present invention relates to a device for cleaning the interior of a flexible container or bag.

2. Discussion of Background

In various industries, including the textile industry, materials in the form of liquids, powders, or granules are supplied in heavy duty plastic bags within large boxes. These materials and boxes can weigh as much as 2000 pounds. These bulk bag dischargers are employed as stand alone volumetric or as loss-in-weight feeders and are used to supply the material in the bags to a process line. The bags are attached to the discharges and then inverted, so that their contents flow into a concentric reducer and then into the process line.

In many industries these bags contain hazardous or contaminated materials, which must be handled with care. After being emptied, the bags themselves are considered hazardous material, because of the residual material within the bags. Therefore, due to hazardous materials regulations, the bags must be handled and disposed of properly. Even if the bags do not contain hazardous materials, they still must be disposed of properly. The boxes that contain the bags do not come into contact with the material and thus may be reused, recycled, or otherwise disposed of without hazardous material considerations. Consequently, there is a need for a device that treats, processes, rinses, or washes the interior of these bags, so that they are cleaned and not considered hazardous waste, allowing them to be reused, recycled or disposed of without consideration of the hazardous materials regulations.

SUMMARY OF THE INVENTION

According to its major aspects and broadly stated, the present invention is a bulk bag dispenser having a concentric reducer with at least two, and preferably four, nozzles which emit a fluid, either a liquid or a gas. The concentric reducer has a mouth wherein a bag containing a bulk material is affixed. The mouth and bag are oriented so that the interior of the bag and its contents can be introduced into the concentric reducer. The bag is typically affixed to the concentric reducer by a drawstring initially and thereafter by a clamping device.

The nozzles comprise an inner and outer cylinder, wherein the outer cylinder extends through the wall of the concentric reducer. The inner cylinder slidably fits within the outer cylinder so that it passes into the mouth of the concentric reducer and into the interior of the bag. The inner cylinder has a spherical or mushroom shaped cap and a conduit extending approximately the length of the cylinder. Preferably four orifices, positioned proximate to the cap, penetrate to the exterior of the inner cylinder and communicate with the conduit. In the preferred embodiment, the orifices are at an approximately 45° incline, so that the fluid can reach areas higher than the nozzles. Where the orifices exit the inner cylinder a notch or scalloped opening is positioned which optimizes the spray pattern of the fluid and ideally the liquid. The conduit of one nozzle is connected to a liquid source, so that when a pressurized liquid is introduced into the conduit, the liquid flows through these orifices. The other conduit is connected to a gas source, thus providing pressurized gas into the interior of the bag, which helps expand the bag as it is being emptied and washed.

As stated above, the inner cylinder is slidably mounted within the outer cylinder. A pneumatic cylinder is connected to the inner cylinder near its bottom and moves the inner cylinder between a retracted position and an extended position. As the inner cylinder moves from its retracted position, the fluid, either liquid or gas, is emitted from the orifices, thus washing and expanding the interior of the bag. The shape of the cap of the inner cylinder is important, so that it does not tear or catch on the bag as the cylinder is moved to its extended position. When moving between its two positions, inner cylinder will engage the interior surface of the bag and lift it, thus helping expand the bag even more, so that the liquid will have better access to the interior of the bag during its washing.

In its retracted position, the fluid within the conduit is prevented from flowing into the interior of the bag. In this position, the cap of inner cylinder engages the top end of the outer cylinder, and with a first seal carried by the cap, prevents the respective fluid from escaping into the interior of the bag. A second seal between the inner cylinder and the outer cylinder prevents this fluid from passing into the interior of the bag. A pair of seals positioned within the outer cylinder and slidably engaging the inner cylinder prevents the respective fluid from passing between the inner cylinder and the outer cylinder. Consequently, the combination of the cap engaging the top of the outer cylinder and the seals prevents the fluid from flowing when the inner cylinder is in its retracted position.

A major feature of the present invention is the use of at least two, and preferably four, nozzles to complete the washing and rinsing process. By using at least one of the nozzles to supply pressurized gas into the interior of the bag, the bag is expanded more than it would be with a single liquid nozzle. Expanding the bag not only helps during the washing and rinsing process, but also helps during the emptying process. The gas carrying nozzles can be extended with gas flowing into the interior of the bag during this emptying process, thus enabling the contents of the bag to flow down the concentric reducer with a greater ease.

An important feature of the present invention is having the inner cylinder slidably mounted within the outer cylinder. With this arrangement, the inner cylinder can be moved between its retracted position and its extended position, thus gaining access to the complete interior of the bag and enabling the bag to be more thoroughly washed.

Another important feature of the present invention is that the cap of the inner cylinder engages the interior surface of the bag as it moves between its two positions. By engaging the interior surface, the bag is lifted, thus providing better access to the interior of the bag for the washing liquid.

Still another important feature of the present invention is the shape of the cap of the inner cylinder. The cap has a spherical or mushroom shape that will not catch or tear the interior of the bag as the inner cylinder is moved between its two positions.

Yet another important feature of the present invention is that the fluid, either liquid or gas, is prevented from flowing when the inner cylinder is in its retracted position. The combination of the cap and seal carried by the cap engaging the top end of the outer cylinder, and the seals positioned above and below the orifices, respectively, act to "cut-off" the flow of gas or liquid into the interior of the bag and the mouth of the concentric reducer.

Still another feature of the present invention is the conduit within the interior of the inner cylinder. This conduit fluidly communicates between a gas or liquid source and the orifices which open onto the exterior of the inner cylinder. The conduit allows a pressurized gas or liquid to travel the length of the inner cylinder and then be emitted from the orifices into the interior of the bag.

Yet another important feature of the present invention is the angular incline of the orifices that fluidly communicate with the exterior of the inner cylinder and the conduit. The angular incline allows the gas or liquid to be sprayed to a height higher than the cap of the inner cylinder, thus allowing a greater area of the interior of the bag to be washed.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
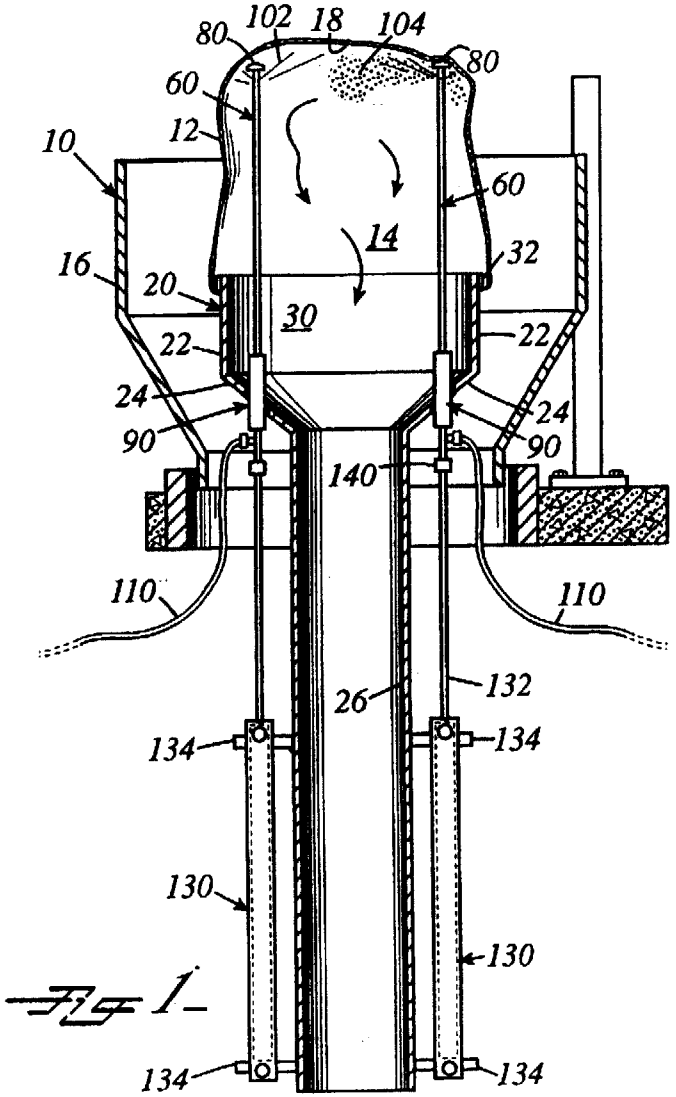
FIG. 1 is a partial cross-sectional view of a nozzle and container cleaning system showing two nozzles in their extended position and emitting a gas and fluid, respectively, according to a preferred embodiment of the present invention.
Figure 2:
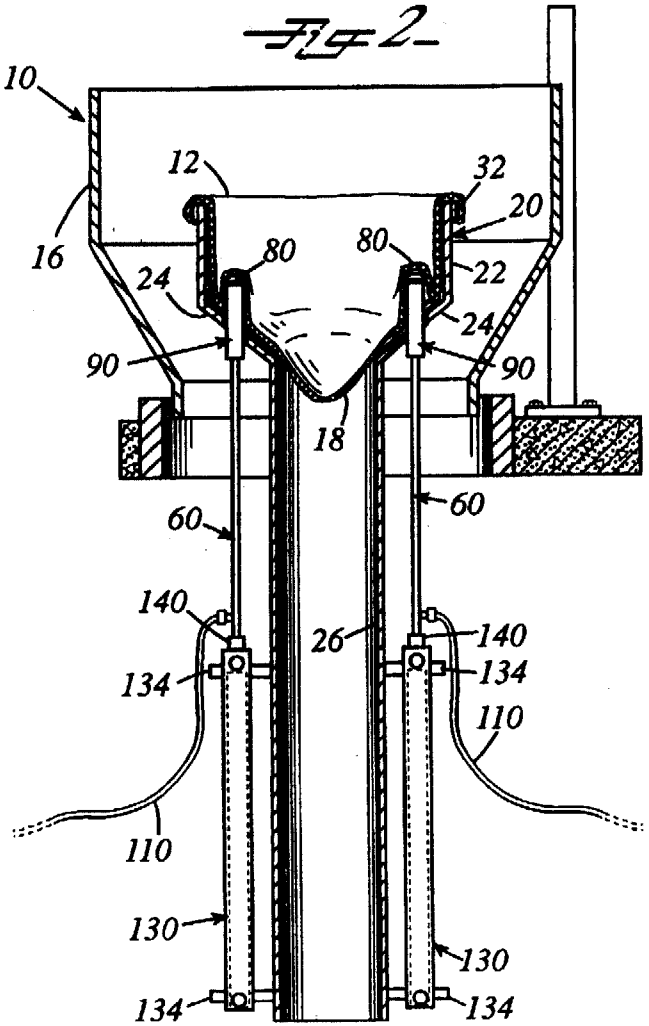
FIG. 2 is a partial cross-sectional view of a nozzle and container cleaning system showing two nozzles in their retracted position according to a preferred embodiment of the present invention.

Referring now to FIGS. 1 and 2, a bulk bag dispenser 10 having a concentric reducer 20 with a pair of nozzles 50 is shown. In the preferred embodiment at least two nozzles 50, and preferably four, are disposed within concentric reducer 20. If there are only two nozzles 50 within the system, one nozzle 50 will be used to emit a gas 102, while the other emits a liquid 104. While in the preferred embodiment of the present invention between two and four nozzles 50 are used within the cleaning system, a single nozzle 50 could be employed and still remain within the scope of this disclosure. Furthermore, while a pair of nozzles 50 are shown in FIGS. 1 and 2 disposed at opposing hemispheres of reducer 20, the combination or placement of nozzles 50 within reducer 20 can be modified, as will be seen by those skilled in the art, and still remain within the scope of this disclosure.

During the description of the present invention as described by this specification and defined by the appended claims, the term fluid 100 refers to both gases 102 and liquids 104.

Bulk bag dispenser 10 is used in industry to unload and process materials in the form of liquids, powders, or granules that are supplied in heavy duty plastic bags within large boxes. These materials are then used within the manufacturing process. Bulk bag dispenser 10 comprises an outer chamber 16 having concentric reducer 20 mounted therein.

Concentric reducer 20 comprises a first cylindrical wall 22, a second cylindrical wall 24, and a channel 26. First and second cylindrical walls 22, 24 form a mouth 30 which leads to channel 26. Second cylindrical wall 24 reduces the diameter of concentric reducer 20 between first cylindrical wall 22 and channel 26, while first cylindrical wall 22, second cylindrical wall 24, and channel 26 remain concentric.

During the operation of bag dispenser 10, the materials arrive at the site in heavy plastic bags 12 within large boxes. An operator first attaches bag 12 to first cylindrical wall 22 of reducer 20 by a drawstring, so that the interior 14 of bag 12 communicates with mouth 30. After the drawstring has been attached, a clamp 32 is attached around bag 12 and first cylindrical wall 22, thus further securing the communication between interior 14 and mouth 30. After bag 12 has been secured to reducer 10, the contents of bag 12 descend within channel 26 to their point of destination. Gas 102 carrying nozzles 50 can be used to facilitate this emptying process, as will be described in more detail below. What remains after the emptying process is bag 12 contaminated with the residue of its previous contents; consequently, it is important to clean or wash interior 14 of bag 12, so that it can be disposed of properly as uncontaminated waste.

Nozzles 50 are designed and constructed similarly, irrespective of whether liquid 104 or gas 102 is being emitted. Consequently, during the following description, a single nozzle design will be disclosed; however, it is understood that this design is suitable for both gas 102 and liquid 104 fluids. Nozzle 50 comprises an inner cylinder 60 and an outer cylinder 90 and emits a fluid 100 into interior 14 of bag 12. Outer cylinder 90 penetrates through second cylindrical wall 24 of reducer 20, so that outer cylinder 90 communicates with mouth 30. Outer cylinder 90 is sealed with respect to second cylindrical wall 24 by a seal 92, which prevents any material from bag 12 or fluid 100 from escaping the boundaries of concentric reducer 20. Seal 92 can be constructed from rubber or any other material or sealing device known to those skilled in the art for fluidly sealing two objects. It should be noted that it is contemplated that outer cylinder 90 can penetrate either first cylindrical wall 22 or second cylindrical wall 24 and still remain within the scope of this disclosure.

Inner cylinder 60 is slidably mounted within the inside 94 of outer cylinder 90. Inner cylinder 60 slides between a retracted position, as specifically shown FIG. 2, and an extended position, as specifically shown in FIG. 1. When inner cylinder 60 is in its retracted position, fluid 100 is prevented from flowing into interior 14 of bag 12, as will be described in detail later. As inner cylinder 60 moves away from its retracted position towards its extended position, fluid 100 is permitted to flow.

Inner cylinder 60 comprises a top end 62, a bottom end 64, and a conduit 70, which extends approximately the length of inner cylinder 60. Conduit 70 communicates with the exterior 66 of inner cylinder 60 proximate to top end 62 and bottom end 64. Four orifices 76 communicate between conduit 70 and exterior 66 of inner cylinder 60, and are disposed equally about the circumference of inner cylinder 60. Consequently, one orifice 76 is positioned on each quadrant of the circumference of inner cylinder 60. Orifices 76 exit inner cylinder 60 at an approximately 45° angular incline, and thus communicate with conduit 70 closer to bottom end 64, than the position where orifices 76 communicate with exterior 66. Orifices 76 are designed with an angular incline, so that portions of interior 14 of bag 12, which would not otherwise be reached by fluid 100, can be washed, rinsed, or expanded. At the position where each orifice 76 exits inner cylinder 60 is a notch 78. Notch 78 is a scalloped or countersink hole that widens the exit of orifice 76. In the preferred embodiment, notch 78 functions to give a preferred spray pattern; however, those skilled in the an will recognize that notch 78 is not required in order for nozzle 50 to function, nor is the exact shape of notch 78 required. Furthermore, those skilled in the art will recognize that modifications to notch 78 can be made to adjust the spray pattern of fluid 100 without departing from the teachings of this disclosure.

It should also be noted that the number of orifices 76, four, or the specific angular incline of 45° in the preferred embodiment, should not be construed as limiting. Those skilled in the art will recognize that differing numbers of orifices 76 could be disposed about the circumference of inner cylinder 60 and still remain within the teachings of this disclosure. All that is required is that at least one orifice 76 communicate with conduit 70 and exterior 66. Similarly, the angular incline should not be construed as limiting the teachings of this disclosure, as those skilled in the art will recognize that varying angles could be substituted for orifices 76. However, it is important that there be some sort of incline to orifice 76, so that interior 14 of bag 12 positioned above inner cylinder 60 can be washed, rinsed, or expanded.

Figures 3A, 3B, 4:
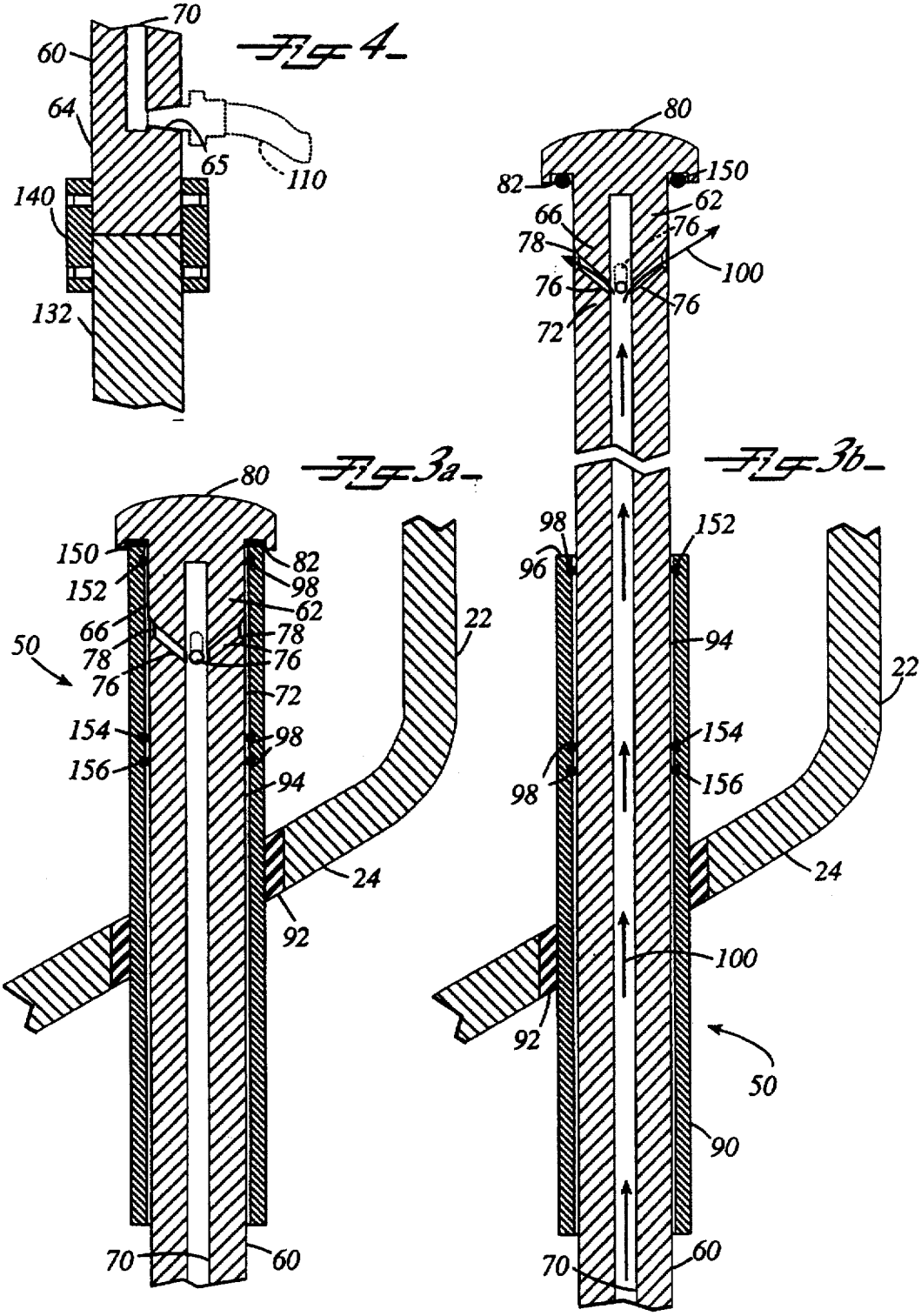
FIG. 3*a* is a cross-sectional detail view of a nozzle and container cleaning system showing the inner cylinder in its retracted position according to a preferred embodiment of the present invention.
FIG. 3*b* is a cross-sectional detail view of a nozzle and container cleaning system showing the inner cylinder in its extended position according to a preferred embodiment of the present invention.
FIG. 4 is a cross-sectional detail view of the bottom end of the inner cylinder of a nozzle and container cleaning system according to a preferred embodiment of the present invention.

As stated above, fluid conduit 70 communicates with exterior 66 of inner cylinder 60 proximate to bottom end 64 at an entrance 68, as shown in FIG. 4. Entrance 68 communicates between conduit 70 and exterior 66 of inner cylinder 60. Entrance 68 is designed to receive a fluid source 110 supplying fluid 100 under pressure to conduit 70 within nozzles 50. Entrance 68 can be threaded or otherwise designed to enable fluid source 110 to be quickly connected. As described above, fluid 100 can consist of gas 102 or liquid 104; consequently, fluid source's 110 connection to entrance 68 may be dependent on the contents of fluid source 110, liquid 104 or gas 102. Those skilled in the art will recognize many modifications and substitutions for the connection of fluid source 110 to entrance 68. Consequently, these modifications and substitutions are within the teachings and scope of the present disclosure.

Inner cylinder 60 has a cap 80 affixed to top end 62, wherein cap 80 has a spherical or mushroom shape. As inner cylinder 60 moves between its extended and retracted position, cap 80 engages the interior surface 18 of bag 12, thus raising and expanding bag 12, so that it will be more exposed to fluid 100. The shape of cap 80 is important, so that as inner cylinder 60 moves between its two positions, engaging interior surface 18, cap 80 does not catch or snag and thus rip or tear interior surface 18. Those skilled in the art will recognize that modifications to the shape of cap 80 can be made and still remain within the scope of this disclosure. Therefore, it is merely important that the shape of cap 80 be such that cap 80 is smooth and void of any sharp edges, so that it will not rip or tear bag 12.

Inner cylinder 60 is moved between its extended position and retracted position by a pneumatic air cylinder 130 having a shaft 132 and a pair of mounts 134. Shaft 132 of air cylinder 130 is connected to bottom end 64 of inner cylinder 60 by a coupling device 140. Coupling device 140 can be any device known to those skilled in the art for connecting axially aligned shafts. Also, other types of connections may be substituted for coupling device 140 to axially connect shaft 132 and inner cylinder 60. Mounts 134 merely allow air cylinder 130 to be attached to channel 26 of reducer 20. Those skilled in the art will recognize that other mounting sites and other types of mounting devices for air cylinder 130 are possible and within the scope of this disclosure. Furthermore, those skilled in the art will recognize that other types of linear motion devices, including linear slides and hydraulic cylinders, may be substituted for air cylinder 130 without departing from the teachings and scope of the present disclosure.

As stated above, when inner cylinder 60 is in its retracted position, as best shown in FIG. 3*a*, fluid 100 is prevented from flowing into mouth 30 of reducer 20 or interior 14 of bag 12. In the preferred embodiment, four sealing devices are used to prevent fluid 100 from flowing. The first fluid seal is carried by the base of cap 80 in an annular groove 82 and comprises a first o-ring 150. Cap 80 is dimensioned so that it has a larger diameter than the inner diameter of outer cylinder 90. This is important so that cap 80 will engage the top 96 of outer cylinder 90 when inner cylinder 60 is in its retracted position. Furthermore, in the retracted position, first o-ring 150 carried by cap 80 of inner cylinder 60 is compressed against top 96 of outer cylinder 90, thus effectively fluidly sealing mouth 30 and interior 14 from inside 94 of outer cylinder 90. To further complete this seal, a second o-ring 152 is mounted within a recess 98 within inside 94 of outer cylinder 90, positioned proximate to top 96 and above orifices 76, when inner cylinder 60 is in its retracted position. Second o-ring 152 is maintained in a fixed position with respect to outer cylinder 90, but slidably engages inner cylinder 60 when inner cylinder 60 is moved between its two positions. Second o-ring 152 not only helps seal during the retracted position, but also prevents fluid 100 from entering inside 94 of outer cylinder 90, when inner cylinder 60 is between its retracted position and its extended position.

Positioned below orifices 76, when inner cylinder 60 is in its retracted position, are third o-ring 154 and fourth o-ring 156. Third and fourth o-rings 154, 156 are similar to second o-ring 152 and are positioned in recesses 98. Third and fourth o-rings 154, 156 slidably engage the surface of inner cylinder 60 as inner cylinder 60 moves between its two positions. When inner cylinder 60 is in either its retracted position or extended position, third and fourth o-rings 154, 156 prevent fluid 100 from flowing within outer cylinder 90. Those skilled in the an will recognize that both third and fourth o-rings 154, 156 are not required, and either a single o-ring or a plurality of o-rings could be substituted and still remain within the scope of this disclosure. Furthermore, those skilled in the an will recognize that other sealing devices could be substituted for first, second, third, and fourth o-rings 150, 152, 154, 156, without departing from the scope of this disclosure.

Outer cylinder 90 should be designed to have a substantially shorter length than inner cylinder 60. Outer cylinder 90 must be merely long enough to penetrate through second cylindrical wall 24 of reducer 20 and house inner cylinder 60, so that orifices 76 are positioned between first and second o-rings 150, 152 and third and fourth o-rings 154, 156. Furthermore, it is necessary that fluid source 110 connected to entrance 68 have clearance from outer cylinder 90 as inner cylinder 60 moves between its two positions. Those skilled in the art will recognize that outer cylinder 90 could have a longer length, so long as some clearance, such as a slot, is provided for the travel of fluid source 110. It may also be possible to connect fluid source 110 to conduit 70, so as not to interfere with outer cylinder 90 during the movement of inner cylinder 60, thus removing the requirement that outer cylinder 90 be substantially shorter than inner cylinder 60.

In operation, bag 12 is connected first to concentric reducer 20 by a drawstring and then clamp 32, as described above. After bag 12 is attached to reducer 20, the contents of bag 12 are emptied down channel 26 of concentric reducer 20, as shown in FIG. 2. Gas 102 carrying nozzle 50 may then be actuated to help lift bag 12, so that the remainder or any relatively large contents of bag 12 are transported down channel 26. After the contents have been emptied, inner cylinder 60 of liquid 104 carrying nozzles 50, with fluid source 110 providing pressurized liquid 104, moves towards its extended position. At this time both liquid 104 and gas 102 carrying nozzles 50 are being extended, so that both liquid 104 and gas 102 are injected into interior 14 of bag 12. During this movement, which is controlled by air cylinder 130, fluid 100 is sprayed through orifices 76 into interior 14 of bag 12. Inner cylinder 60 is raised, rinsing and expanding interior 14, while cap 80 engages interior surface 18 of bag 12, thus exposing more of bag 12. Furthermore, gas 102, as it is being injected into interior 14 of bag 12, lifts bag 12, so that more of bag 12 is exposed. Liquid 104, after rinsing interior of bag 12, flows through mouth 30 of reducer 20 and then down channel 26. After rinsing and washing bag 12, inner cylinder 60 of both nozzles 50 is returned to its retracted position, thus cutting off the flow of fluid 100 and allowing bag 12 to be removed from reducer 20, so that it can be recycled or reused.

It should be noted that while the present invention is disclosed in terms and for use in washing and rinsing the interior of a flexible container, such as a bag, it could be used to wash and rinse other containers, materials, and objects. Consequently, the present invention as described in this disclosure and defined by the appended claims, should not be construed to be limited to merely washing and rinsing the interior of a bag.

It will be apparent to those skilled in the an that many changes and substitutions can be made to the preferred embodiment herein described without departing from the spirit and scope of the present invention as defined by the appended claims.

What is claimed is:

1. A bulk bag dispenser for use in dispensing the contents of a bag, said dispenser comprising:

a reducer having a mouth and a wall, said wall having a hole formed therein;

a nozzle extending though said hole in said wall, said nozzle movable between an extended position and a retracted position and adapted to spray a fluid;

means for moving said nozzle between said extended and said retracted positions; and a source of fluid connected to said nozzle so that, when a bag is affixed to said mouth of said reducer over said nozzle and said nozzle has been moved by said moving means from said retracted position and said source of fluid supplies fluid to said nozzle, said fluid flows through said nozzle and into said bag to wash said bag.

2. The bulk bag dispenser as recited in claim 1, wherein said nozzle further comprises:

an inner cylinder having an orifice formed therein; and an outer cylinder, said outer cylinder attached to said wall and said inner cylinder slidable within said outer cylinder;

said moving means moving said inner cylinder with respect to said outer cylinder between said extended and said retracted positions;

said fluid flowing from said orifice in said inner cylinder of said nozzle into said bag.

3. The bulk bag dispenser as recited in claim 1, wherein said nozzle further comprises:

an inner cylinder having an orifice formed therein;

an outer cylinder, said outer cylinder attached to said wall and said inner cylinder slidable within said outer cylinder; and a cap on said inner cylinder;

said moving means moving said inner cylinder with respect to said outer cylinder between said extended and said retracted positions;

said fluid flowing from said orifice in said inner cylinder of said nozzle into said bag.

4. The bulk bag dispenser as recited in claim 1, wherein said nozzle further comprises:

an inner cylinder having an orifice formed therein;

an outer cylinder, said outer cylinder attached to said wall and said inner cylinder slidable within said outer cylinder; and first seal means between said inner cylinder and said outer cylinder;

said moving means moving said inner cylinder with respect to said outer cylinder between said extended and said retracted positions;

said fluid flowing from said orifice in said inner cylinder of said nozzle into said bag.

5. The bulk bag dispenser as recited in claim 1 wherein said nozzle further comprises:

an inner cylinder having an orifice formed therein;

an outer cylinder, said outer cylinder attached to said wall and said inner cylinder slidable within said outer cylinder;

a cap on said inner cylinder;

first seal means for sealing against said fluid leaking between said inner cylinder and said outer cylinder; and second seal means for sealing against said fluid leaking between said cap and said wall when said inner cylinder is in said retracted position;

said moving means moving said inner cylinder with respect to said outer cylinder between said extended and said retracted positions;

said fluid flowing from said orifice in said inner cylinder of said nozzle into said bag.

6. The bulk bag dispenser as recited in claim 1, wherein said nozzle is formed to spray said fluid upward and is positioned between said bag and said wall, so that when said said nozzle sprays said fluid into said bag, said bag is lifted by the force of said spraying fluid.

7. The bulk bag dispenser as recited in claim 1, wherein said nozzle further comprises:

an inner cylinder having an orifice formed therein at an angular incline; and an outer cylinder, said outer cylinder attached to said wall and said inner cylinder slidable within said outer cylinder;

said moving means moving said inner cylinder with respect to said outer cylinder between said extended and said retracted positions;

said fluid flowing from said orifice in said inner cylinder of said nozzle into said bag.

8. The bulk bag dispenser as recited in claim 1, wherein said moving means is a pneumatic cylinder.

9. A bulk bag dispenser for use in dispensing the contents of a bag, said dispenser comprising:

a reducer having a mouth and a wall, said wall having two holes formed therein;

a first nozzle extending though a first hole of said two holes in said wall, said nozzle movable between an extended position and a retracted position and adapted to spray a liquid;

a second nozzle extending though a second hole of said two holes in said wall, said nozzle movable between an extended position and a retracted position and adapted to spray a liquid;

means for moving said first and said second nozzles between said extended and said retracted positions;

a source of liquid connected to said first nozzle, so that when a bag is affixed to said mouth of said reducer over said first nozzle and said second nozzle and said first nozzle has been moved by said moving means from said retracted position and said source of liquid supplies liquid to said first nozzle, said liquid flows through said first nozzle and into said bag; and a source of gas connected to said second nozzle, so that when a bag is affixed to said mouth of said reducer over said first nozzle and said first nozzle and said second nozzle have been moved by said moving means from said retracted position and said source of gas supplies gas to said second nozzle, said gas flows through said second nozzle and into said bag to wash said bag.

10. A bulk bag dispenser for use in dispensing the contents of a bag, said dispenser comprising:

a reducer having a mouth and a wall, said wall having at least two holes formed therein;

a plurality of nozzles extending though said at least two holes in said wall, one of said plurality of nozzles extending through one of said at least two holes, said plurality of nozzles movable between an extended position and a retracted position and adapted to spray fluid;

means for moving said plurality of nozzles between said extended and said retracted positions; and a source of fluids connected to said plurality of nozzles, so that when a bag is affixed to said mouth of said reducer over said plurality of nozzles and said plurality of nozzles has been moved by said moving means from said retracted position and said source of fluids supplies fluids to said plurality of nozzles, said fluids flow through said plurality of nozzles and into said bag to wash said bag.

* * * * *